United States Patent [19]

Pray

[11] 4,146,974

[45] Apr. 3, 1979

[54] DRYING APPARATUS

[76] Inventor: Robert W. Pray, Greenwich Lodge, Greenwich, Conn. 06830

[21] Appl. No.: 834,335

[22] Filed: Sep. 19, 1977

[51] Int. Cl.[2] ..... F26B 3/28

[52] U.S. Cl. ..... 34/54; 34/4; 34/41; 34/62; 219/343; 432/4

[58] Field of Search ..... 34/4, 41, 49, 54, 155, 34/62, 66, 67; 219/388 R, 388 W, 388 S, 358, 354, 343; 432/4

[56] References Cited

U.S. PATENT DOCUMENTS

| | | | |
|---|---|---|---|
| 2,955,342 | 10/1960 | Litzler et al. | 34/54 |
| 3,720,002 | 3/1973 | Martin | 34/41 |
| 3,765,475 | 10/1973 | Hooper | 219/343 |
| 3,894,343 | 7/1975 | Pray et al. | 34/49 |
| 3,973,328 | 8/1976 | Theobald | 34/41 |

*Primary Examiner*—John J. Camby
*Assistant Examiner*—Larry I. Schwartz
*Attorney, Agent, or Firm*—Eugene E. Geoffrey, Jr.

[57] ABSTRACT

Apparatus for drying webs which includes a housing having two compartments with one compartment open on one side and having heating elements therein. The other of said compartments is closed and has air inlet and outlet openings for circulation of air normally therethrough. An air control valve is disposed between the compartments and functions to direct all of the air into the open compartment should the web speed decrease or the movement of the web terminate completely.

6 Claims, 6 Drawing Figures

5
22
13
15
10
29
23
30
31
4
27
32
17
14
33
26
25
24
28
16
19
37
20
18
13'
21
W

5

13
15
23
30
31
27
33
17
32
24
28
26
25
16
19
37
18
20
13'
21
W 41
38
13
12
24
19
20
37
27
28
25
34
16
28
36
35
32
28

DRYING APPARATUS

This invention relates to drying apparatus for drying moving webs of material and more specifically to infra-red drying apparatus useful among other things for drying printed webs of flammable material.

Prior known drying apparatus whether using infra-red or ultra violet radiation was designed to function in relatively close proximity to the moving web and any decrease in speed of the web would burn, if not ignite the web. Accordingly, such prior apparatus of necessity included means to reduce automatically the radiation impinging on the web by withdrawing the heating elements, shielding the web or taking other suitable action in order to prevent damage to the web. In the case of infra-red, for instance, temperatures of the order of 800° F. are utilized and radiators may be spaced from 1 to 6 inches from the web. As a result, any malfunction in the web transport apparatus can result in ignition of the web in less than three seconds. In large printing press installations, this can result not only in a substantial loss of time in rethreading the press but substantial danger to both equipment and operating personnel.

This invention overcomes the problems heretofore encountered with web drying apparatus and provides a novel and improved infra-red dryer having means for heating a moving web and means for controlling the flow of air through the dryer to provide a normal flow during the drying operation and in the event of any malfunction in the transport of the web or intentional or accidental reduction of speed the air flow is instantaneously redirected to cool the web and maintain its temperature below the burning point.

Another object of the invention resides in the provision of a novel and improved dryer embodying and improved nozzle for controlling the flow of air over the web during normal operation and cooling the web below the ignition temperature with an increased flow of air produced when the web speed decreases.

The foregoing objects are attained through the provision of a dryer having a housing which includes an upper closed compartment and a lower compartment open at the bottom with heating elements mounted therein. Air normally enters the upper compartment to cool the partition between the upper and lower compartments as well as any electrical wiring therein. A portion of the air is also directed onto the web to remove volatile gases liberated during drying. In the event the web speed should decrease an air control valve disposed between the upper and lower compartments is opened to direct all of the air into the lower compartment to cool the web and the heating elements to prevent damage to the web.

The above and other objects of the invention will become more evident from the following description and accompanying drawings forming part of this application.

Figure 1:
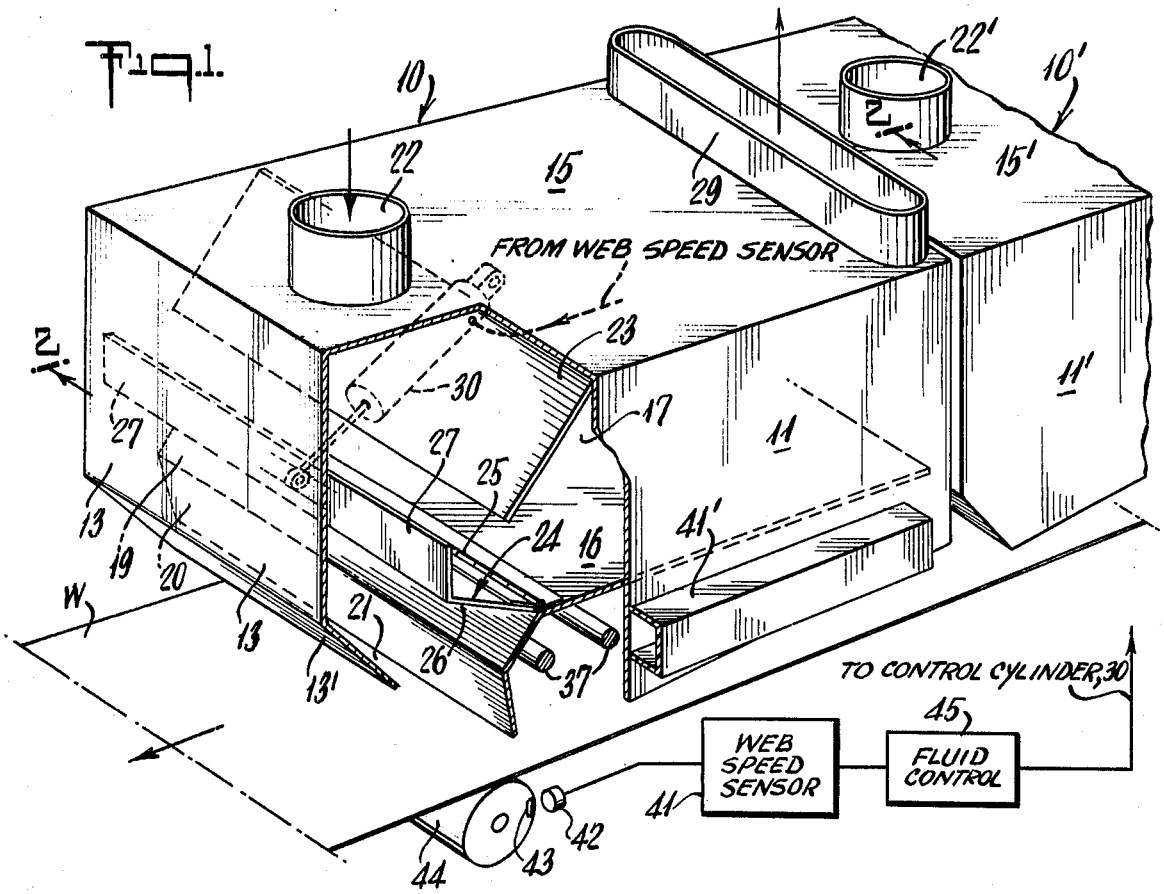
FIG. 1 is a perspective view of one embodiment of drying apparatus in accordance with the invention.

Referring now to the drawings, one embodiment of a dryer in accordance with the invention is illustrated in FIG. 1 and denoted generally by the numeral 10. While the dryer can be of any desired length and width they are preferably about 8 to 16 inches in length along the web and may either extend throughout the entire width of the web or a succession of dryers may be positioned in side by side relationship across the web. The preferred limitation of the length of the dryer is to provide for adequate distribution of air along the length of the web if an extended drying period is required. Should a succession of dryers be required they would be positioned in a space relationship in the direction of movement of the web as illustrated for instance in FIG. 1 which shows a fragmentary portion of a second dryer denoted by the numeral 10' and which is spaced from the dryer 10 to provide for air flow between the dryers. This arrangement provides, in general, a minimum of 0.05 cubic feet per minute of air per watt of electrical energy as that quantity of air is generally required to maintain the web below the ignition point should the web speed either be suddenly decreased or the web stopped completely. While dryers 10 and 10' are shown on one side of the web W, similar dryers may be used on the other side of the web so that both sides can be dried simulteneously. Moreover, the web need not be horizontally disposed but may move vertically between sets of driers or at any other selected angle.

Each dryer 10 comprises an outer rectangular housing having side walls 11 and 12, forward and rear walls 13 and 14, an upper wall 15 and a partition 16 forming essentially an upper compartment 17 and a lower compartment 18. The wall 13 on the forward edge of the dryer has a downwardly and inwardly inclined portion 13' which terminates at a point spaced above the web W. The partition 16 terminates short of the forward wall 13 and is provided with a downwardly formed wall extending throughout the width of the dryer and comprising a downwardly and outwardly disposed portion 19 and a downwardly and rearwardly disposed portion 20 which terminates above the lower end of the wall portion 13' and slightly rearwardly thereof to form a nozzle having an air discharge opening 21.

Figure 2:
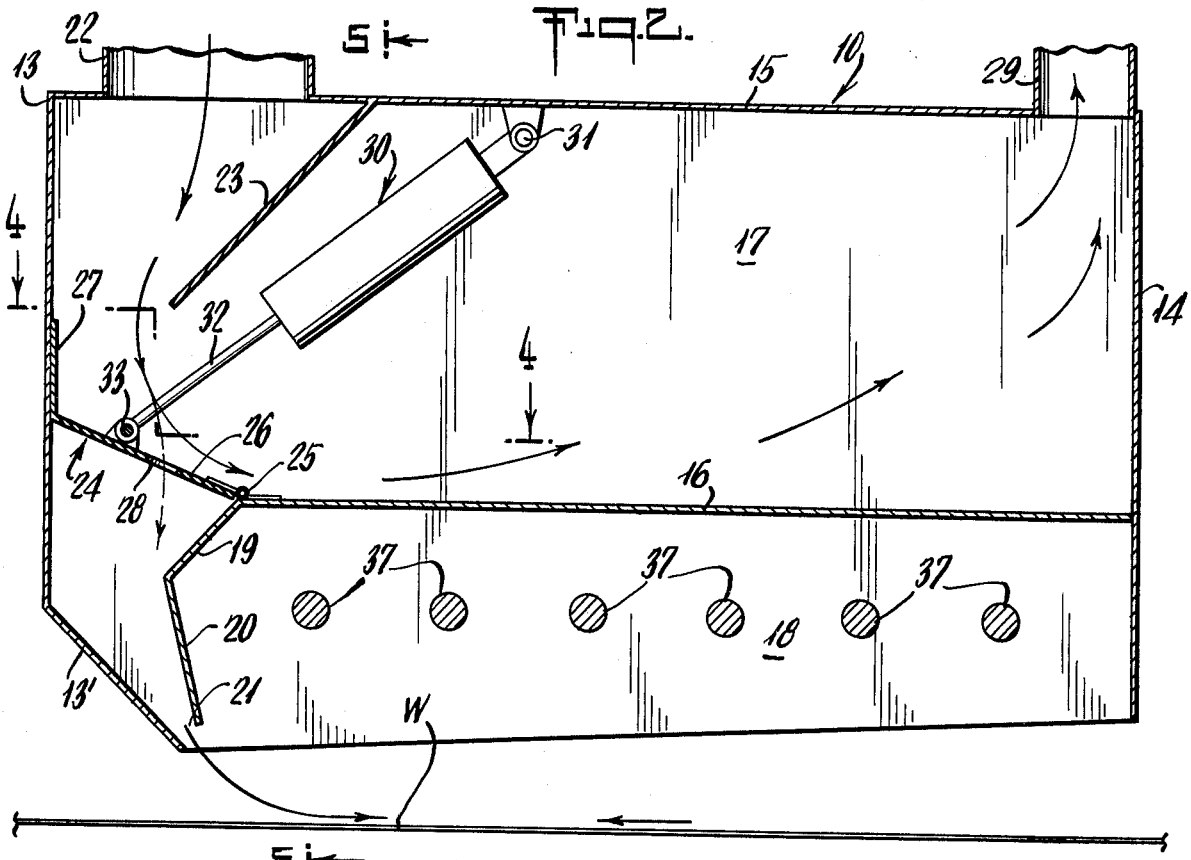
FIG. 2 is a cross sectional view of FIG. 1 taken along the line 2—2 thereof.

The top wall 15 of the dryer has an air inlet opening 22 and a downwardly and forwardly inclined baffle 23 just below the inlet opening. An air valve 24 is hinged to the forward edge of the partition 16 by means of a hinge 25. The valve in the closed position, as shown in FIG. 2, lies flat against the forward wall 13. The valve portion 26 also includes plurality of openings 28 to provide for the flow of a proportion of the air from the inlet 22 through the openings 28 and the nozzle 21 and produce a small amount of cooling for the web and also provide adequate air to remove vapors which may be liberated from the web during the drying process. The major portion of the air however, sweeps downwardly over the partition 16 and is discharged through the outlet 29. Operation of the valve 24 is effected by a suitable pneumatically or hydraulically operated cylinder 30 which is pivoted at 31 to the upper wall 15 and has its piston rod 32 pivoted at 33 to the valve 24. Equivalent mechanical means may also be employed. In order to effect proper operation of the valve with a single cylinder the valve is provided with a pair of upwardly extending spaced ears 34 which carry a transverse shaft 35. The piston rod 32 has a collar 36 surrounding the shaft 35 which functions as the pivot 33.

Figure 3:
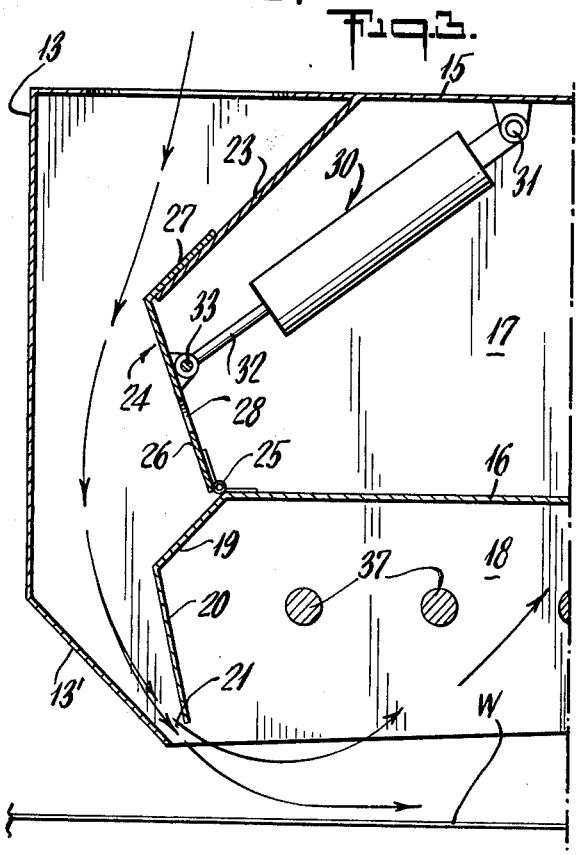
FIG. 3 is a fragmentary portion of FIG. 2 showing the air control valve in position to direct substantially all of the air onto the web about the heating elements.
Figure 4:
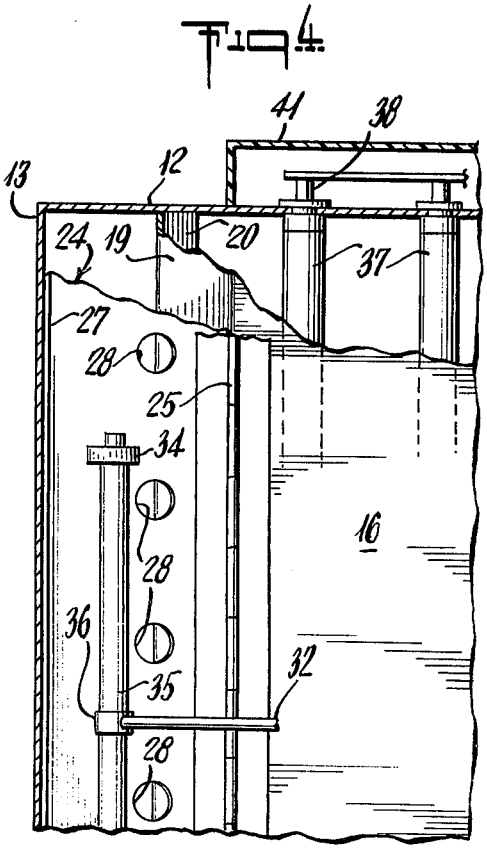
FIG. 4 is a cross sectional view of FIG. 2 taken along the line 4—4 thereof.

With the arrangement as described above, the piston 30 is actuated whenever the web W experiences a material reduction in speed or its forward motion terminated. In such cases the piston 30 functions to move the valve 24 to the open position as shown in FIG. 3 whereupon all of the air through the inlet 22 emerges from the nozzle 21 and is sufficient to keep the web W below the ignition temperature. At the same time some of the air is directed in and about the heating elements 37 to aid in carrying off some of the heat and the air is then discharged beneath the side and rear walls of the dryer.

Figure 5:
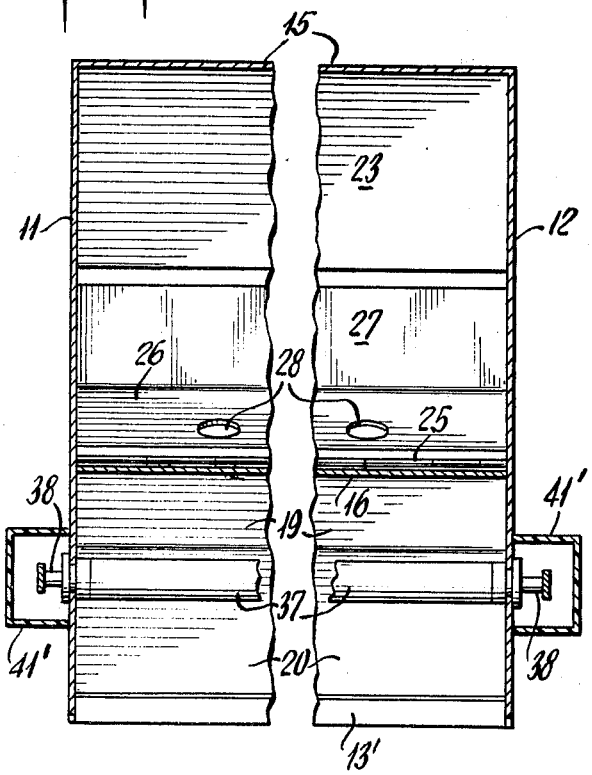
FIG. 5 is a cross sectional view of FIG. 2 taken along the line 5—5 thereof.
Figure 6:
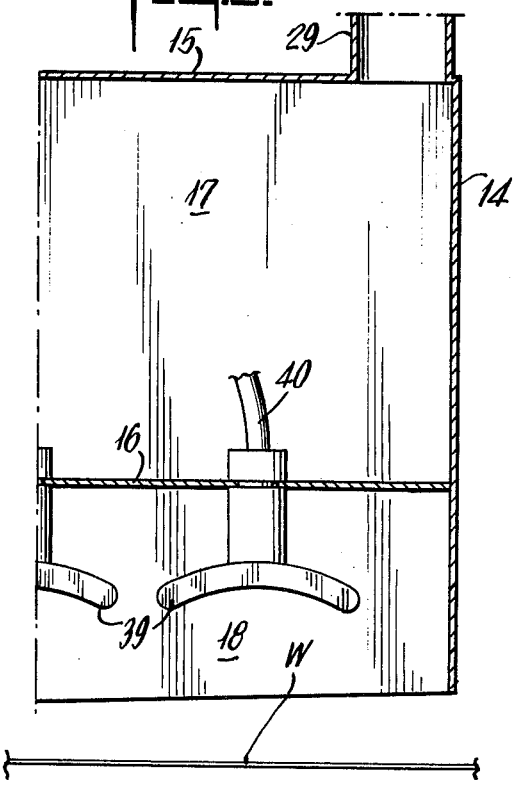
FIG. 6 is a fragmentary portion of FIG. 2 showing a modified form of heating element.

The heating elements 37 may take any desired form such as cylindrical elements extending between the side walls 11 and 12 as shown for instance, in FIG. 5. In this case the end terminals 38 of each heating element are interconnected with those of other elements and with suitable source of energy in order to develop the desired radiant energy for drying the web. In the alternative arcuately shaped heaters such as shown for instance, in FIG. 6 and denoted by the numeral 39 may be employed in which case the heaters would be supported by the partition 16 and the electric cabling means 40 for coupling the heaters to a source of energy would be disposed within the compartments 17 and cooled by the normal flow of air therethrough. In the case of the heaters 37, as shown in FIG. 5, the end terminals 38 are enclosed by suitable channels 41 to protect the terminals and prevent injury to operating personnel.

Referring to FIG. 1, the actuating cylinder 30 for the valve 24 may be activated by any suitable means for sensing web speed. For instance, a magnetic senser 42 may be connected to the web speed senser 41 and react to a magnet 43 carried by a roller 44 to measure web speed. In this way, should the web speed and thus the speed of roller 44 decrease, this information would be fed to the fluid control 45 which in turn would actuate the cylinder 30 to open the valve 24 to the position shown in FIG. 3. Thus, all of the air normally circulated to the upper compartment 17 would be directed downwardly onto the web and about the heating elements to prevent ignition of the web. As soon as the web speed increased to normal speed, the reverse operation would result and the valve 24 would be closed to the position shown for instance, in FIGS. 1 and 2.

The novel and improved drying apparatus as discussed above is capable of producing temperatures of the order of 800° F. to 4000° F. for the purpose of drying webs and without the possibility of web ignition which could endanger an entire factory. With apparatus in accordance with the invention, a constant air flow is provided at all times so that if the web speed be decreased for any reason whatsoever, whether intentionally or accidentally, the valve 24 would function instantly to direct all of the air onto the web and thus maintain the web automatically below the ignition temperature. It therefore follows that should the web be instantaneously increased in speed the valve 24 will immediately close in order to continue the proper drying process.

The nozzle 21 which is formed by the walls 13' and 20 as shown in FIG. 2 may take a variety of configurations. In forming the nozzle however, it is preferable that the vertical opening formed by the ends of the wall portions 13' and 20 should be of the order of 1/32" to ¼" and the angle at which air is discharged from the nozzle should be in the range 25° to 65° below a plane parallel to the path of the web. With that arrangement it has been found that the dryer performs effectively in drying webs and at the same time prevents accidental ignition.

While only certain embodiments of the invention have been illustrated and described it is understood that alterations, changes and modifications may be made without departing from the true scope and spirit of the invention.

What is claimed is:

1. Apparatus for drying and curing moving webs comprising a housing having an open side, a partition in said housing substantially parallel to said open side, said partition partially dividing said housing into a first compartment and a second compartment, the latter having said open side, heating means in said second compartment, an air inlet in said housing and air outlet means in said first compartment, an air valve in cooperative relationship with said partition to direct air from said inlet through said first compartment to said outlet when in one position and to direct air from said inlet directly onto said web when in another position, said housing including top, side and rear walls, a forward wall having a downwardly and rearwardly formed portion, said partition terminating at a line spaced from said forward wall and having a downwardly extending portion cooperating with said forward wall portion to form a nozzle, and said air valve is carried by the forward end of said partition and functions in said other position to direct air through said nozzle.

2. Apparatus according to claim 1 wherein said air inlet is in the forward portion of said top wall, said outlet is at the rearward portion of said top wall, and said top wall includes means cooperating with said air valve in said other position to direct substantially all air through said nozzle.

3. Apparatus according to claim 2 wherein the last said means comprises a downwardly extending baffle and said air valve comprises a plate hinged to the forward edge of said partition and movable from said one position in contact with said forward wall to the other position in contact with baffle.

4. Apparatus according to claim 1 including means sensing the speed of said web, means for moving said web, means coupled to said valve and actuated by said sensing means for maintaining said valve in said one position when said web is moving at a selected drying speed and instantaneously moving said valve to the other position in the event of a selected decrease in web speed.

5. Apparatus for drying moving webs comprising a housing having heating means for directing radiation onto a web to be dried, means for shielding the side of said heating means opposite said web, air inlet and outlet means including an air nozzle on said housing and air control means for directing air through said housing and over said shield during normal movement of the web and directing substantially all of said air through said nozzle and onto the web and about the heating means in the event of a decrease in the rate of web movement.

6. Apparatus for drying and curing moving webs comprising a rectangular housing having a forward wall and an open side, a partition in said housing substantially parallel to said open side, said partition partially dividing said housing into a first compartment and a second compartment, the latter having said open side, means for moving said web substantially parallel to and spaced from said open side, said partition having means cooperating with the forward wall to form a nozzle, heating means in said second compartment, an air inlet in said housing and an air outlet in said first compartment, an air valve in cooperative relationship with said partition to direct at least a major portion of said air from said inlet through said first compartment to said outlet when in one position and to direct the major portion of the air from said inlet directly through said nozzle on to said web when in another position.

* * * * *